US012669301B2

(12) United States Patent
Boruchowski et al.

(10) Patent No.: US 12,669,301 B2
(45) Date of Patent: Jun. 30, 2026

(54) INTEGRATED FEED RAMP FOR A SHOTGUN

(71) Applicant: Palmetto State Armory LLC, Colubmia, SC (US)

(72) Inventors: Thaddeus Boruchowski, Columbia, SC (US); Ryan Crisp, Columbia, SC (US); Chris Daniels, Columbia, SC (US); Ralph Stephen Fisher, Columbia, SC (US); Mark Mnich, Columbia, SC (US); Thomas Victa, Columbia, SC (US)

(73) Assignee: Palmetto State Armory LLC, Columbia, SC (US)

( * ) Notice: Subject to any disclaimer, the term of this patent is extended or adjusted under 35 U.S.C. 154(b) by 0 days.

(21) Appl. No.: 19/029,810

(22) Filed: Jan. 17, 2025

(65) Prior Publication Data

US 2025/0237448 A1 Jul. 24, 2025

Related U.S. Application Data

(60) Provisional application No. 63/623,223, filed on Jan. 20, 2024.

(51) Int. Cl.
*F41A 9/01* (2006.01)
*F41C 7/02* (2006.01)

(52) U.S. Cl.
CPC . *F41A 9/01* (2013.01); *F41C 7/02* (2013.01)

(58) Field of Classification Search
CPC ..... F41A 9/01; F41C 7/02
See application file for complete search history.

(56) References Cited

U.S. PATENT DOCUMENTS

| | | | | | |
|---|---|---|---|---|---|
| 1,565,384 | A * | 12/1925 | Nelson | F41C 7/02 | 42/21 |
| D110,729 | S * | 8/1938 | Mossberg | D22/108 | |
| 2,570,772 | A * | 10/1951 | Crittendon | F41A 3/40 | 89/190 |
| 2,645,873 | A * | 7/1953 | Crittendon | F41A 3/40 | 42/21 |
| 5,361,526 | A * | 11/1994 | Campbell | F41A 17/44 | 42/70.11 |
| D828,893 | S * | 9/2018 | Adolfson | D22/108 | |
| 2007/0240352 | A1* | 10/2007 | Pullicar | F41A 9/72 | 42/70.11 |
| 2014/0130787 | A1* | 5/2014 | Macy | F41B 11/55 | 124/73 |
| 2014/0196342 | A1* | 7/2014 | Syrengelas | F41C 7/02 | 156/60 |
| 2014/0250751 | A1* | 9/2014 | Foster | F41A 11/02 | 42/6 |
| 2015/0128467 | A1* | 5/2015 | Fitzpatrick | F41C 7/02 | 29/434 |
| 2020/0224985 | A1* | 7/2020 | McLeroy | F41A 3/66 | |
| 2022/0364818 | A1* | 11/2022 | Maguire | F41A 99/00 | |

* cited by examiner

*Primary Examiner* — Joshua E Freeman
(74) *Attorney, Agent, or Firm* — Douglas L. Lineberry

(57) ABSTRACT

Described herein is an integrated feed ramp for a shotgun, methods for making same, and methods of retrofitting existing firearms, wherein the integrated feed ramp feeds shells directly into the loading port of the magazine tube of the shotgun.

18 Claims, 3 Drawing Sheets

INTEGRATED FEED RAMP FOR A SHOTGUN

This application claims the benefit of U.S. Provisional Patent Application No. 63/623,223, filed Jan. 20, 2024, the disclosure of this application is expressly incorporated herein by reference in its entirety.

TECHNICAL FIELD

The subject matter disclosed herein is generally directed to an integrated feed ramp for a shotgun, methods for making same, and methods of retrofitting existing firearms, wherein the integrated feed ramp feeds shells directly into the loading port of the magazine tube of the shotgun.

BACKGROUND

Shotguns are popular around the world for hunting, shooting sports and home defense. They fire shells of metal shot that are usually loaded one at a time, instead of provided in groups of shells inside a magazine. While shotgun technology has advanced over the years, loading most shotguns is still a cumbersome task. Indeed, even professional shooter's shotguns show mars and damage from a shotgun shell hitting the bottom or side of the shotgun while loading shells and damaging the finish of the shotgun.

Referring to FIG. 1, for prior art devices, one pushes shell 102 into loading port 104 of shotgun magazine tube 106. There is no aid provided for doing so and loading the firearm may be slowed, or a shell jammed into the loading port, via a shell being pushed at too high or low of an angle of entry into loading port 104. Further, some shooters turn the shotgun upside down in order to make this process less arduous, thus further slowing reloading and use of the firearm, see FIG. 1.

What is needed in the art is an improved way to load a shotgun that provides a guide for shells entering the loading port and magazine tube. Accordingly, it is an object of the present disclosure to provide an integrated feed ramp for a shotgun that guides and directs shotgun shells into the loading port of a shotgun magazine tube to improve loading consistency and provide repeated, smooth loading of a shotgun.

Citation or identification of any document in this application is not an admission that such a document is available as prior art to the present disclosure.

SUMMARY

The above objectives are accomplished according to the present disclosure by providing in one aspect an integrated feed ramp for a shotgun. The integrated feed ramp may include at least one ramp wherein the at least one ramp is formed as part of at least one trigger guard; at least one engagement surface defined on the at least one ramp configured to engage at least one shotgun shell; at least one proximal end of the at least one feed ramp and at least one distal end of the at least one feed ramp; and the at least one distal end of the at least one feed ramp may be configured to deliver the at least one shotgun shell into at least one loading port of the shotgun. Further, the at least one ramp may be integral with the at least one trigger guard. Additionally, the at least one ramp may be configured to be removable with respect to the at least one trigger guard. Still further, the at least one ramp may comprise at least one polymer, steel or aluminum. Yet again, the at least one feed ramp may be concave. Moreover, the at least one ramp may vary in width along a length of the integrated feed ramp. Furthermore, the at least one integrated feed ramp may vary in depth along a length of the integrated feed ramp. Still again, the at least one feed ramp may vary in depth and in width along a length of the integrated feed ramp. Still yet further, the integrated feed ramp may be formed in at least two sections to comprise a length of the integrated feed ramp.

In a further aspect, the current disclosure provides a method for forming an integrated feed ramp for a shotgun. The method may include forming at least one ramp wherein the at least one ramp is formed as part of at least one trigger guard; defining at least one engagement surface on the at least one ramp configured to engage at least one shotgun shell; forming at least one proximal end of the at least one feed ramp; forming at least one distal end of the at least one feed ramp; and configuring the at least one distal end of the at least one feed ramp to deliver the at least one shotgun shell into at least one loading port of the shotgun. Still further, the at least one ramp may be formed as integral with the at least one trigger guard. Also, the at least one ramp may be configured as removable with respect to the at least one trigger guard. Further yet, the at least one ramp may be formed from at least one polymer, steel or aluminum. Additionally, the at least one feed ramp may be formed as concave. Again further, the at least one ramp may be configured to vary in width along a length of the integrated feed ramp. Still yet again, the at least one integrated feed ramp may be configured to vary in depth along a length of the integrated feed ramp. Moreover, the at least one feed ramp may be configured to vary in depth and in width along a length of the integrated feed ramp. Still yet, the integrated feed ramp may be configured in at least two sections to comprise a length of the integrated feed ramp.

In another aspect, the current disclosure provides a method for retrofitting an existing shotgun platform to incorporate an integrated shotgun ramp. The retrofitting method may include removing an existing trigger guard from a shotgun body; smoothing any rough surface areas employed to secure the existing trigger guard to the shotgun body; and securing an integrated trigger guard frame into a location where the existing trigger guard had occupied. Additionally, the integrated trigger guard frame may include at least one ramp wherein the at least one ramp is formed as part of at least one integrated trigger guard frame; at least one engagement surface defined on the at least one ramp configured to engage at least one shotgun shell; at least one proximal end of the at least one feed ramp and at least one distal end of the at least one feed ramp; and the at least one distal end of the at least one feed ramp may be configured to deliver the at least one shotgun shell into at least one loading port of the shotgun.

These and other aspects, objects, features, and advantages of the example embodiments will become apparent to those having ordinary skill in the art upon consideration of the following detailed description of example embodiments.

BRIEF DESCRIPTION OF THE DRAWINGS

An understanding of the features and advantages of the present disclosure will be obtained by reference to the following detailed description that sets forth illustrative embodiments, in which the principles of the disclosure may be utilized, and the accompanying drawings of which.

Figure 1:
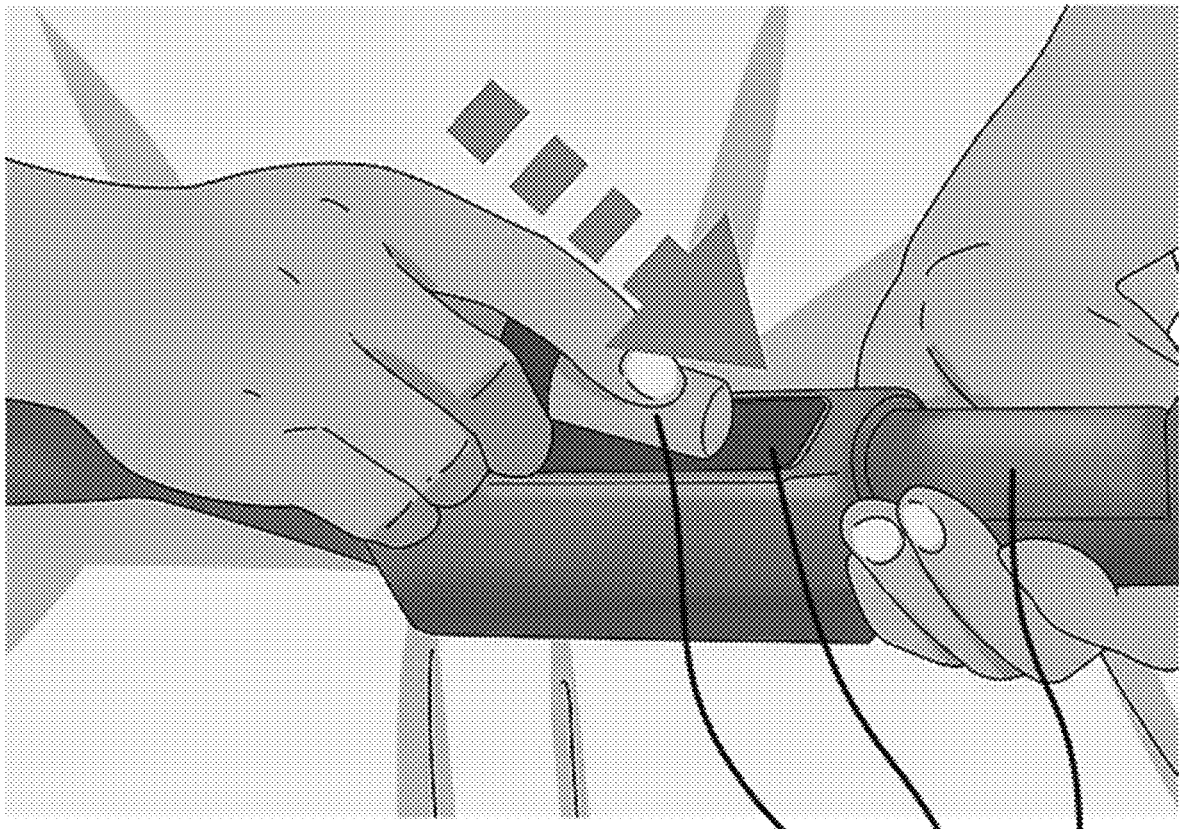
FIG. 1 PRIOR ART
FIG. 1 shows a prior art method of loading a shotgun.
Figure 2:
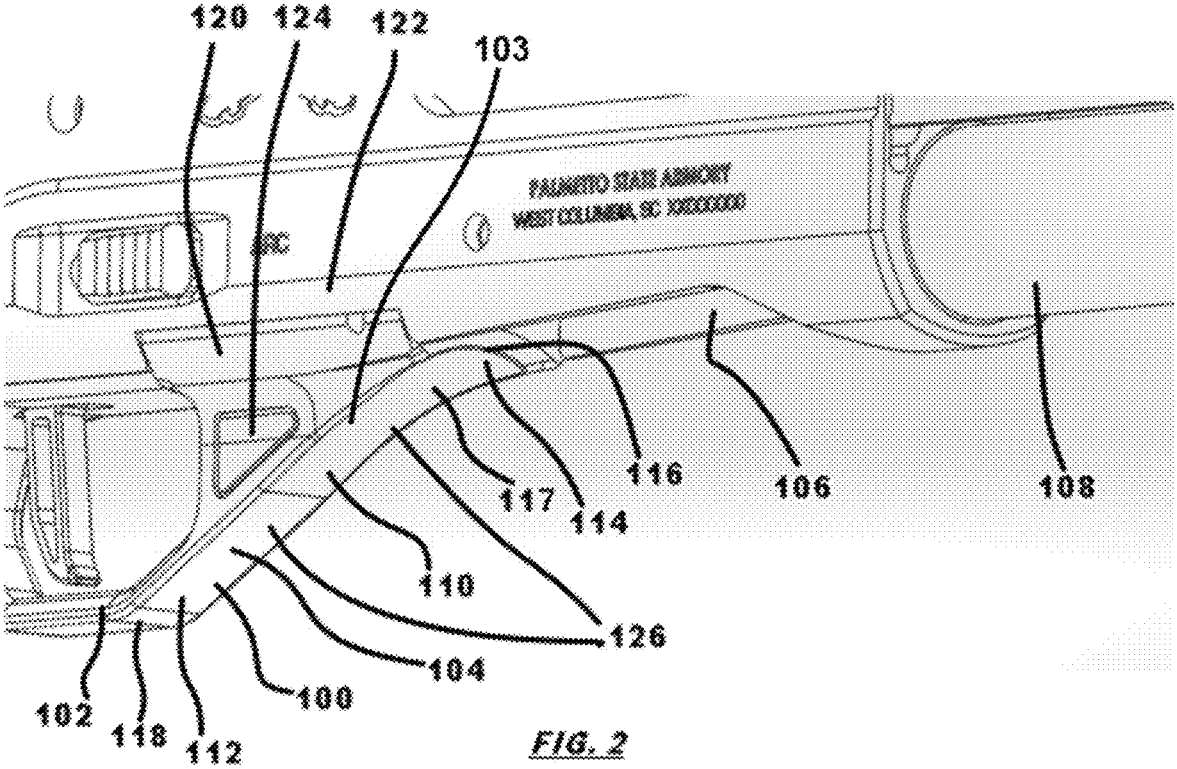
FIG. 2 shows a shotgun with an integrated feed ramp of the current disclosure.

The figures herein are for illustrative purposes only and are not necessarily drawn to scale.

DETAILED DESCRIPTION OF THE EXAMPLE EMBODIMENTS

Before the present disclosure is described in greater detail, it is to be understood that this disclosure is not limited to particular embodiments described, and as such may, of course, vary. It is also to be understood that the terminology used herein is for the purpose of describing particular embodiments only and is not intended to be limiting.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant application should not be treated as such and should not be read as defining any terms appearing in the accompanying claims. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Where a range is expressed, a further embodiment includes from the one particular value and/or to the other particular value. The recitation of numerical ranges by endpoints includes all numbers and fractions subsumed within the respective ranges, as well as the recited endpoints. Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure. For example, where the stated range includes one or both of the limits, ranges excluding either or both of those included limits are also included in the disclosure, e.g., the phrase "x to y" includes the range from 'x' to 'y' as well as the range greater than 'x' and less than 'y'. The range can also be expressed as an upper limit, e.g., 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

As used herein, the singular forms "a", "an", and "the" include both singular and plural referents unless the context clearly dictates otherwise.

As used herein, "about," "approximately," "substantially," and the like, when used in connection with a measurable variable such as a parameter, an amount, a temporal duration, and the like, are meant to encompass variations of and from the specified value including those within experimental error (which can be determined by e.g., given data set, art accepted standard, and/or with e.g., a given confidence interval (e.g., 90%, 95%, or more confidence interval from the mean), such as variations of +/−10% or less, +/−5% or less, +/−1% or less, and +/−0.1% or less of and from the specified value, insofar such variations are appropriate to perform in the disclosure. As used herein, the terms "about," "approximate," "at or about," and "substantially" can mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

The term "optional" or "optionally" means that the subsequent described event, circumstance or substituent may or may not occur, and that the description includes instances where the event or circumstance occurs and instances where it does not.

As used interchangeably herein, the terms "sufficient" and "effective," can refer to an amount (e.g., mass, volume, dosage, concentration, and/or time period) needed to achieve one or more desired and/or stated result(s). For example, a therapeutically effective amount refers to an amount needed to achieve one or more therapeutic effects.

As used herein, "tangible medium of expression" refers to a medium that is physically tangible or accessible and is not a mere abstract thought or an unrecorded spoken word. "Tangible medium of expression" includes, but is not limited to, words on a cellulosic or plastic material, or data stored in a suitable computer readable memory form. The data can be stored on a unit device, such as a flash memory or CD-ROM or on a server that can be accessed by a user via, e.g., a web interface.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s). Reference throughout this specification to "one embodiment", "an embodiment," "an example embodiment," means that a particular feature, structure or characteristic described in connection with the embodiment is included in at least one embodiment of the present disclosure. Thus, appearances of the phrases "in one embodiment," "in an embodiment," or "an example embodiment" in various places throughout this specification are not necessarily all referring to the same embodiment but may. Furthermore, the particular features, structures or characteristics may be combined in any suitable manner, as would be apparent to a person skilled in the art from this disclosure, in one or more embodiments. Furthermore, while some embodiments described herein include some, but not other features included in other embodiments, combinations of features of different embodiments are meant to be within the scope of the disclosure. For example, in the appended claims, any of the claimed embodiments can be used in any combination.

All patents, patent applications, published applications, and publications, databases, websites and other published materials cited herein are hereby incorporated by reference to the same extent as though each individual publication, published patent document, or patent application was specifically and individually indicated as being incorporated by reference.

Kits

Any of the integrated feed ramps for a shotgun, methods for making or methods for retrofitting an existing shotgun to include same described herein may be presented as a combination kit. As used herein, the terms "combination kit" or "kit of parts" refers to the parts, tools, accessories and any additional components that are used to package, sell, market, deliver, and/or provide the combination of elements or a single element, such as the integrated feed ramp for a shotgun. Such additional components include, but are not limited to packaging, blister packages, tools, and the like. When one or more of the parts, tools, accessories and any additional components described herein or a combination thereof (e.g., parts in the kit are provided simultaneously), the combination kit can contain the integrated feed ramp for a shotgun singularly or in separate embodiments. When the parts, tools, accessories and any additional components described herein or a combination thereof and/or kit components are not provided simultaneously, the combination kit can contain the parts, tools, accessories and any additional components in separate embodiments. The separate kit components can be contained in a single package or in separate packages within the kit.

In some embodiments, the combination kit also includes instructions printed on or otherwise contained in a tangible medium of expression. The instructions can provide information regarding the parts, tools, accessories and any additional components, safety information regarding the contents, information regarding use, and/or recommended maintenance regimen(s) for the parts, tools, accessories and any additional components contained therein. In some embodiments, the instructions can provide directions and protocols for assembling or installing the parts, tools, accessories and any additional components described herein. In some embodiments, the instructions can provide one or more embodiments of the integrated feed ramp for a shotgun or methods for making or retrofitting an existing shotgun to include the integrated feed ramp for a shotgun such as any of the methods described in greater detail elsewhere herein.

The current disclosure provides an integrated feed ramp for a shotgun that guides and directs shotgun shells into the loading port of a shotgun magazine tube to improve loading consistency and provide repeated, smooth loading of a shotgun. Referring to FIG. 1, in one embodiment, integrated feed ramp 100 may be formed as part of trigger guard 102 to allow a shell, not shown, to slide down integrated ramp engagement surface 104 and into loading port 106 of magazine tube 108. Further, while integrated feed ramp 100 is shown as unitary or integral with trigger guard 102, the current disclosure is not so limited and a "snap on" or affixable and removable integrated feed ramp 100 may be affixed to an existing shotgun trigger guard to provide for easier loading of shells.

Referring again to FIG. 1, integrated feed ramp 100 may be made from various materials, including metals, such as aluminum, steel, titanium, metallic alloys, etc., or other materials such as synthetics, polymers, plastics, etc. In a preferred embodiment, polymer may be used as well as steel and aluminum. Further, integrated feed ramp 100 may be formed as a slide and/or angled platform to provide consistent shell entry into loading port 106. The features of the ramp may be shaped in a curve or 'V' or 'U' or other concave shape that allows the shells to self-center in a trough that guides them to the loading port. This allows pressure to be applied in the natural act of loading that enhances the presentation of the shells. The ramp may also be sized in width to be larger than the diameter of the shell to ensure that the shell seats into the trough and acts like a chute into the loading port. For instance, the ramp may be one inch wide or variations on this width such as from 1.25 inches to 1.00 inches, from 1.00 inches to 0.75 inches, from 0.75 inches to 0.5 inches or variations encompassing and/or between these measurements such as from 1.25 inches to 0.5 inches, from 1.12 inches to 0.85 inches, etc. Indeed, the ramp may be configured to narrow from its staring point at feeding ramp head 112 along ramp body 103 until reaching distal end 116. These radius and 'V' and 'U' shapes may be optimized for the gauge leading to smaller gauges having larger troughs to match their larger diameters, e.g., a 10-gauge shotgun shell is larger than a 12-gauge shell, which in turn is larger than a 20-gauge shell. The depth of the 'V' or 'U' ramp may also be varied to assist with loading shells into loading port 106 by varying the depth along ramp body 103. For instance, the depth of feed ramp 100 may be constant along the length of feed ramp 100 or may vary or change along the length of feed ramp 100.

Feeding ramp 102 ramp engagement surface 104 may be formed to define a concave surface 110 extending from feeding ramp head 112 extending along feeding ramp engagement surface 104 and through feed ramp exit 114. In some embodiments, feeding ramp head 112 may be formed to be wider, as well as more concave or "deeper", than feeding ramp engagement surface 104 and feed ramp exit 114 with integrated feed ramp 100 tapering along its length so that shells are "funneled" into integrated ramp 100 and ultimately feeding port 106. Integrated feeding ramp may also be configured to increase in concavity from feeding ramp head 112 to feed ramp exit 114 or to remain at a constant degree of concavity along its entire surface. Indeed, feed ramp 100 may have a depth of 1/16, 1/8, 1/4, 1/3, 1/2, 3/4, or 1 inch (or the closest metric measurement thereto depending on the measurement system employed in manufacturing the ramp). Further, the depth of feed ramp 100 may vary from 1/16 to 1 inch (or the closest metric measurement thereto) along the length of the ramp to help firmly set or "hold" a shell into ramp body 103 and guide the shell into loading port 106. Indeed, the depth of feed ramp 100 may vary along its length via use of various of the depths described herein to accommodate various shotgun shell sizes and/or configurations.

Feeding ramp exit 114 may be formed as rounded or with a bend at distal end 116 away from engagement surface upper surface 117 to keep shells from snagging or catching as they pass feed ramp exit 114. Feeding ramp proximal end 118 may also be rounded in order to keep shells and their metal heads from catching or clipping onto integrated feed ramp 100 as they are introduced at proximal end 118 and feeding ramp head 112.

Figure 3:
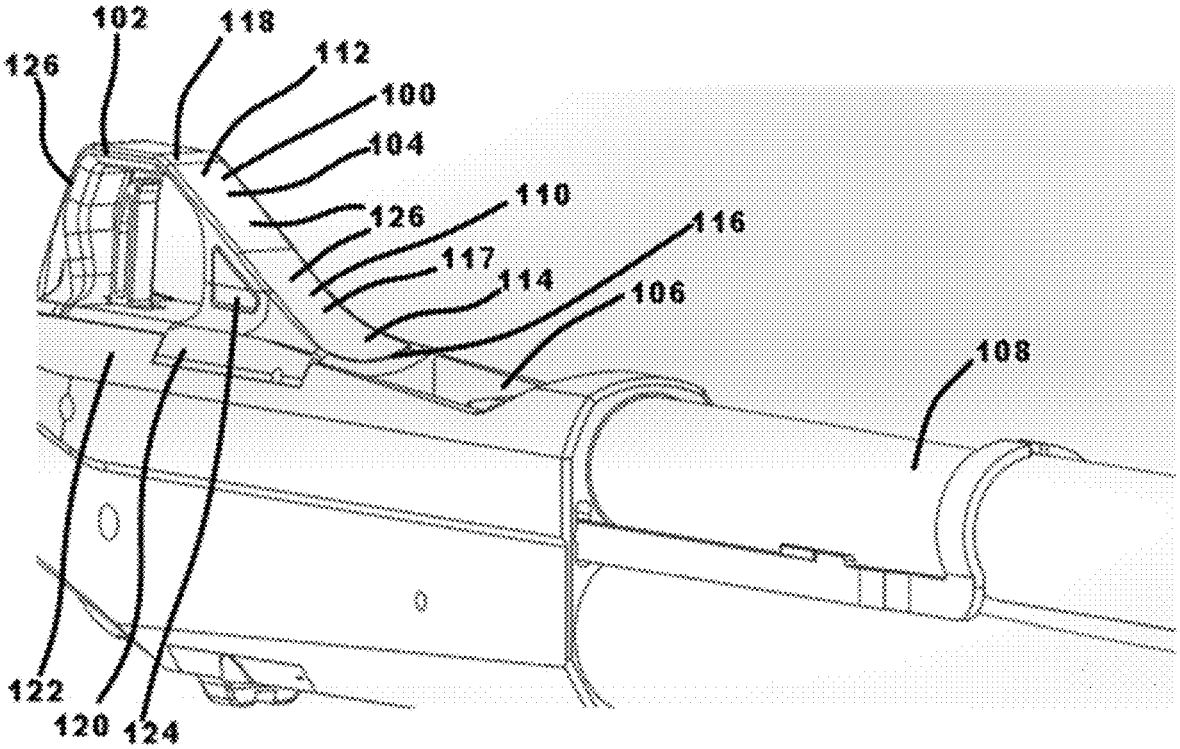
FIG. 3 shows a bottom view of a shotgun incorporating an integrated feed ramp of the current disclosure.

In a further embodiment, integrated feeding ramp 100 may include support base 120 that affixes integrated feeding ramp 100 to shotgun body 122. Further, integrated feeding ramp 100 may define at least one cavity 124 to reduce the weight of integrated feeding ramp 100 as well as the shotgun as a hole. Further, integrated feeding ramp 100 may also be formed in sections 126 along the length of integrated feeding ramp 100. This could include from 2 to 10 sections (or more or less sections and the current disclosure should not be considered limited in this aspect) depending on the functionality desired by the feed ramp. Further, the sections may be configured to vary in depth and width with respect to one another to provide further versatility to the design. Sectionalizing integrated feeding ramp 126 into sections can allow for replacement of sections to accommodate different style shells or replace sections of integrated feeding ramp 100 if they become damaged or develop any obstructions that prevent smooth, guided loading of shotgun shells. Sectionalizing also allows for further user modifications as sections 126 may be provided with more or less concavity, width, slope, angle, etc., to allow users to customize integrated feed ramp 100 to their particular loading style and taste. FIG. 3 shows a bottom view of FIG. 4.

The current disclosure also provides for methods of retrofitting existing shotguns to include integrated feeding ramp 100. To do so, one would remove the existing trigger guard from the shotgun body, smooth any rough surface areas, especially round existing bolt or screw holes or areas where brazing was employed to secure the existing trigger guard, and secure integrated trigger guard frame 126 into the location where the existing trigger guard had occupied. Integrated trigger guard frame 126 can include all facets of integrated feeding ramp 100 as described supra and could be attached to the firearm via threaded bolts, screws, or other means as known to those of skill in the art.

Various modifications and variations of the described methods, devices, and kits of the disclosure will be apparent to those skilled in the art without departing from the scope and spirit of the disclosure. Although the disclosure has been described in connection with specific embodiments, it will be understood that it is capable of further modifications and that the disclosure as claimed should not be unduly limited to such specific embodiments. Indeed, various modifications of the described modes for carrying out the disclosure that are obvious to those skilled in the art are intended to be within the scope of the disclosure. This application is intended to cover any variations, uses, or adaptations of the disclosure following, in general, the principles of the disclosure and including such departures from the present disclosure come within known customary practice within the art to which the disclosure pertains and may be applied to the essential features herein before set forth.

What is claimed is:

1. An integrated feed ramp for a shotgun comprising:

at least one ramp wherein the at least one ramp is formed as part of at least one trigger guard;

at least one engagement surface defined on the at least one ramp configured to engage at least one shotgun shell;

at least one proximal end of the at least one feed ramp and at least one distal end of the at least one feed ramp;

wherein the at least one distal end of the at least one feed ramp is configured to deliver the at least one shotgun shell into at least one loading port of the shotgun; and wherein the at least one ramp is configured to be removable with respect to the at least one trigger guard.

2. The integrated feed ramp for a shotgun of claim 1, wherein the at least one ramp is integral with the at least one trigger guard.

3. The integrated feed ramp for a shotgun of claim 1, wherein the at least one ramp comprises at least one polymer, steel or aluminum.

4. The integrated feed ramp for a shotgun of claim 1, wherein the at least one feed ramp Is concave.

5. The integrated feed ramp for a shotgun of claim 1, wherein the at least one ramp varies in width along a length of the integrated feed ramp.

6. The integrated feed ramp for a shotgun of claim 1, wherein the at least one integrated feed ramp varies in depth along a length of the integrated feed ramp.

7. The integrated feed ramp for a shotgun of claim 1, wherein the at least one feed ramp varies in depth and in width along a length of the integrated feed ramp.

8. The integrated feed ramp for a shotgun of claim 1, wherein the integrated feed ramp is formed in at least two sections to comprise a length of the integrated feed ramp.

9. A method for forming an integrated feed ramp for a shotgun comprising:

forming at least one ramp wherein the at least one ramp is formed as part of at least one trigger guard;

defining at least one engagement surface on the at least one ramp configured to engage at least one shotgun shell;

forming at least one proximal end of the at least one feed ramp;

forming at least one distal end of the at least one feed ramp;

configuring the at least one distal end of the at least one feed ramp to deliver the at least one shotgun shell into at least one loading port of the shotgun; and comprising configuring the at least one ramp as removable with respect to the at least one trigger guard.

10. The method for forming an integrated feed ramp for a shotgun of claim 9, comprising forming the at least one ramp as integral with the at least one trigger guard.

11. The method for forming an integrated feed ramp for a shotgun of claim 9, comprising forming the at least one ramp from at least one polymer, steel or aluminum.

12. The method for forming an integrated feed ramp for a shotgun of claim 9, comprising configuring the at least one feed ramp as concave.

13. The method for forming an integrated feed ramp for a shotgun of claim 9, comprising configuring the at least one ramp to vary in width along a length of the integrated feed ramp.

14. The method for forming an integrated feed ramp for a shotgun of claim 9, comprising configuring the at least one integrated feed ramp to vary in depth along a length of the integrated feed ramp.

15. The method for forming an integrated feed ramp for a shotgun of claim 9, comprising configuring the at least one feed ramp to vary in depth and in width along a length of the integrated feed ramp.

16. The method for forming an integrated feed ramp for a shotgun of claim 9, comprising configuring the integrated feed ramp in at least two sections to comprise a length of the integrated feed ramp.

17. A method for retrofitting an existing shotgun platform to incorporate an integrated shotgun ramp comprising:

removing an existing trigger guard from a shotgun body;

smoothing any rough surface areas employed to secure the existing trigger guard to the shotgun body; and securing an integrated trigger guard frame into a location where the existing trigger guard had occupied.

18. The method for retrofitting an existing shotgun platform to incorporate an integrated shotgun ramp of claim 17, wherein the integrated trigger guard frame includes:

at least one ramp wherein the at least one ramp is formed as part of at least one integrated trigger guard frame;

at least one engagement surface defined on the at least one ramp configured to engage at least one shotgun shell;

at least one proximal end of the at least one feed ramp and at least one distal end of the at least one feed ramp; and wherein the at least one distal end of the at least one feed ramp is configured to deliver the at least one shotgun shell into at least one loading port of the shotgun.

* * * * *